United States Patent [19]

Misterka

[11] 4,227,336

[45] Oct. 14, 1980

[54] MINIATURE HOUSE CONSTRUCTION

[76] Inventor: Robert J. Misterka, 702 Sugar Creek Trail, Convers, Ga. 30207

[21] Appl. No.: 968,355

[22] Filed: Dec. 11, 1978

[51] Int. Cl.[3] ..... A63H 33/14

[52] U.S. Cl. ..... 46/12; 52/264

[58] Field of Search ..... 46/12, 19, 20; 35/16; 52/274, 293

[56] References Cited

U.S. PATENT DOCUMENTS

| | | | |
|---|---|---|---|
| 1,204,908 | 11/1916 | Schwarz | 46/19 |
| 1,337,171 | 4/1920 | Ward | 46/19 |
| 2,104,872 | 1/1938 | Levy | 52/274 |
| 2,217,374 | 10/1940 | Menzel | 52/274 X |
| 4,065,895 | 1/1978 | Shank et al. | 52/274 X |

FOREIGN PATENT DOCUMENTS

| | | | |
|---|---|---|---|
| 915449 | 7/1946 | France | 46/19 |
| 928268 | 5/1947 | France | 46/19 |
| 483085 | 7/1953 | Italy | 46/19 |
| 607376 | 8/1948 | United Kingdom | 46/19 |

*Primary Examiner*—F. Barry Shay

*Attorney, Agent, or Firm*—Newton, Hopkins & Ormsby

[57] ABSTRACT

An L-shaped member which provides a support for the exterior wall sections and the ground flooring in the construction of miniature homes. The member is secured to the top of the foundation pieces and includes a base portion joined to an upstanding shoulder portion. The bottom of an exterior wall section is joined to the base portion and the bottom of the ground flooring is secured to the top of the shoulder portion about the periphery of the flooring. The member provides the correct elevational relationship of the ground flooring to a door in a wall.

1 Claim, 6 Drawing Figures

MINIATURE HOUSE CONSTRUCTION

BACKGROUND OF THE INVENTION

1. Field of the Invention

This invention related to miniature houses and, more particularly, to a support for the exterior walls and the ground flooring in miniature homes.

2. Description of the Prior Art

The construction of miniature homes has become very popular. Kits are provided for the hobbyist which contain miniature wooden tongue and grooved construction components that are coordinated into a complete and easy system for building a miniature house utilizing nothing more than glue and a few simple craft tools, such as a hand saw and miter box. The kits are so arranged that the wall pieces are the correct height for use with prefinished window and door units. Once constructed, the homes can then be decorated to the owner's tastes.

Prior art miniature house construction systems normally included a foundation upon which the ground flooring was joined; the exterior wall sections were connected to the ground flooring about the outer periphery of the flooring. Those systems did not provide a means for obtaining the correct elevational relationship between the ground flooring and the exterior wall sections, particularly the relationship between the top of the ground flooring and a door opening in those wall sections which contain a door. Also, means were not provided in the previous construction of miniature homes for vertically supporting the exterior wall section in relationship to the ground flooring.

SUMMARY OF THE INVENTION

The above disadvantages are overcome by the present invention which includes an L-shaped member which supports both the bottom of the exterior wall sections and the ground flooring. The member includes a flat upper ledge portion which terminates in a depending vertical section which terminates in a laterally projecting bottom ledge portion.

In the construction of miniature homes utilizing the present invention, the underside of the bottom ledge portion of the support member is secured by glue to the top of the foundation or footing pieces which form the basic outline of the house's floor plan so that the rear side of the vertical section of the support member is flush with the inner face of the foundation. The ground flooring is then affixed to the support member by applying glue along the upper ledge portion and pressing the underside of the flooring onto the top ledge portion so that the exposed edge of the flooring is parallel with the depending vertical section.

For those wall sections which contain a door, a single clapboard is joined to the support member by gluing the bottom of the clapboard to the bottom ledge portion. The inside vertical surface of the clapboard abuts the depending vertical section of the support member. Other pieces forming the exterior wall section can then be joined to the clapboard and to each other. The height of the clapboard approximates the distance or elevation between the individual steps of a set of outside steps leading up to a door.

When the flooring and the clapboard are thus glued to the member, the top surface of the floor is at the correct elevation with respect to the clapboard, i.e., the top flooring surface is at the same height as the top of the clapboard. Therefore, when the door in that exterior wall section formed with that clapboard is put into place, the floor will be at the correct position with respect to the threshhold of the door and the steps leading up to the door.

To provide a means of locking the clapboard in the proper position on the bottom ledge portion, a tongue and a groove for mating engagement therewith can be supplied, as having the tongue run longitudinally on the bottom ledge portion and the groove being formed along the bottom surface of the clapboard. For those exterior wall sections which do not contain a door, the single clapboard need not be utilized as its bottom member but may be formed from a plurality of double or triple clapboard units.

The leading edge of the bottom ledge portion may include a downwardly sloping section which overhangs the foundation pieces so as to provide an aesthetic transition between the foundation which may be masonary dressed and the clapboard exterior wall sections.

Alternate construction modes provide for the support member to serve also as the foundation, thereby eliminating the extra construction steps of forming the foundation from the foundation pieces. Also, the support member could be internally formed on the top of the foundation, instead of being a separate element.

Therefore, it is a primary object of the present invention to provide for a support member for the exterior wall sections and the ground flooring in miniature house construction.

Another object of the present invention is to provide a means in the construction of a miniature house for automatically establishing the correct elevational relationship of the ground flooring to the exterior wall sections.

BRIEF DESCRIPTION OF THE FIGURES OF DRAWINGS

DETAILED DESCRIPTION OF THE ILLUSTRATIVE EMBODIMENTS

A. First Embodiment

Figure 1:
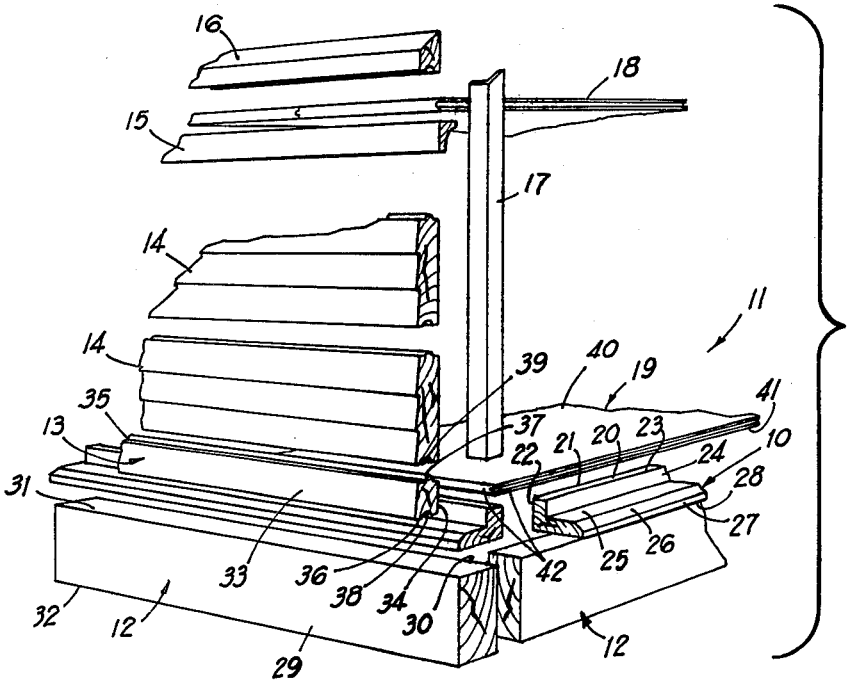
FIG. 1 is an exploded partial perspective view of a miniature home employing the present invention with some elements broken away and others omitted for clarity.

Referring to FIG. 1 of the drawings, the numeral 10 denotes generally the support element of the first embodiment of the present invention which is incorporated within minature house 11. The house 11 includes foundation pieces 12, single clapboard member 13, triple clapboard units 14, floor support/crown moulding 15, eaves strip 16, corner moulding 17, decking 18 and ground flooring 19.

Support element 10 is substantially L-shaped in cross-section and includes a flat upper ledge portion 20 having a rear edge 21, rear wall 22, and a front edge 23 which terminates in depending vertical section 24. Flat bottom ledge portion 25 laterally projects from the bottom of the vertical section 24 and terminates in downwardly sloping portion 26 which terminates in depending section 27. The underside 28 of support member 10 is flat and horizontal. The planes of upper and bottom edge portions 20, 25 are parallel.

The foundation wall is formed by the foundation pieces 12 which are rectangular shaped members having planar front and rear wall surfaces 29, 30 and flat top and bottom surfaces 31 and 32, respectively. The single clapboard 13 is substantially rectangular in shape and includes a vertical front surface 33, a vertical rear surface 34 and top and bottom surfaces 35 and 36, respectively. A longitudinally extending tongue 37 is integrally formed on the top surface 35 and a longitudinally extending groove 38 is formed in bottom surface 36 of the single clapboard 13. The tongue 37 is in mating engagement with groove 39 formed on the bottom of triple clapboard 14 which is joined to the succeeding clapboard 14 by a similar tongue and groove arrangement.

The ground flooring 19 is composed of thin pieces of material which are joined together by a tongue and groove fitting to the requisite dimensions. The flooring 19 includes top and bottom surfaces 40, 41 and exposed edges 42.

In constructing the house 11, the foundation pieces 12 are cut to their proper lengths so as to form the perimeter of the floor plan of house 11 and are joined together with simple joints using nails and/or glue. Most often, the front wall surfaces 29 are covered with miniature bricks, stone, stucco or lattice.

Figure 2:
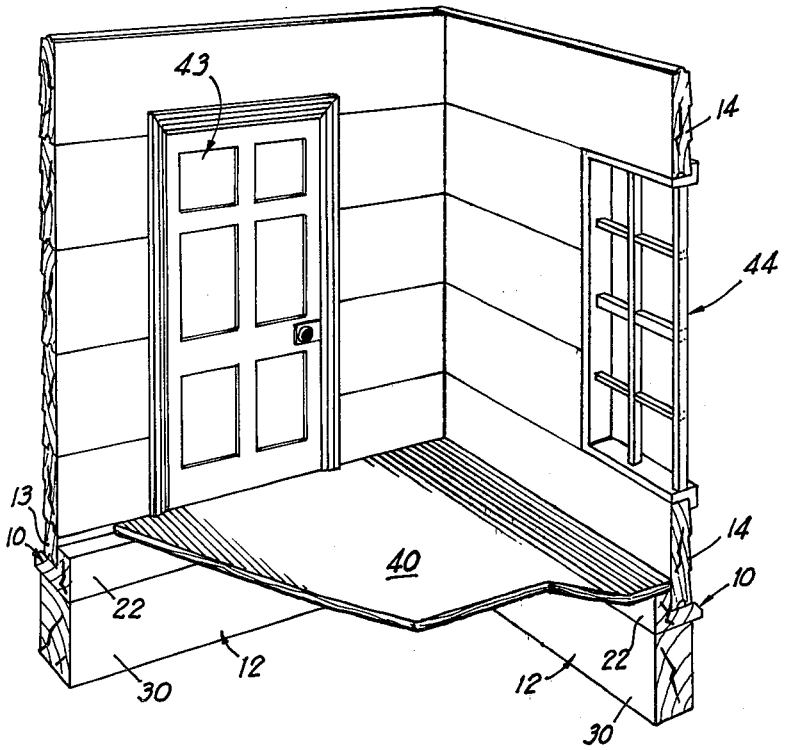
FIG. 2 is a partial perspective view of the interior of a corner section of a miniature house employing the present invention.

The support elements 10 are then cut to the length of each foundation piece 12. It is helpful to miter the end of each support element 10 at a 45° angle. Glue is then applied along the top surface 31 of each foundation piece 12 and the respective support elements 10 are joined along their undersides 28 to the top surfaces 31 so that the rear wall surfaces 22, 30 are flush with each other, as shown in FIG. 2. Once properly joined to the foundation pieces 12, the support elements 10 will have their downwardly sloping portions 26 and depending sections 27 overhang the front wall surfaces 29 to provide a transition between the foundation and the exterior wall sections.

The exterior wall sections may then be formed from the requisite number of single clapboard members 13 and triple clapboard units 14. The single clapboard member 13 is utilized in exterior wall sections that contain a ground floor door 43, as explained hereinbelow. Triple clapboard units 14 may be used in place of a single clapboard 13 when the wall section does not contain a door 43. As seen in FIG. 2, one of the wall sections contains a window 44, the height of which is equal to the width of three triple clapboard units 14. The single clapboard 13 is also used whenever a triple clapboard unit 14 is too tall.

Glue is applied to the tongue 37 on single clapboard member 13 and the tongue 37 is fitted into the groove 39 in the underside of the triple clapboard unit 14 which, in turn, is joined to another unit 14 by similar tongue and groove mating. The last piece to be glued into place on top of the exterior wall sections that are the front and back of house 11 is the eaves strip 16; exterior side walls with gabled peaks do not require the eaves strip 16. If the exterior walls are to be removable rather than stationary and glued in place on the foundation pieces 12, the corner molding 17 could be cut to the length needed to fit along the entire side edge of the exterior wall sections and attached to the sections. The top edge of the corner molding 17 is mitered at a 45° angle so that it will fit properly under the slope of the roof.

The assembly of house 11 is continued by securing two opposed exterior wall sections, which are to be stationary, into place on the support members 10. For those exterior wall sections having a single clapboard member 13 as the bottommost element, as illustrated in FIGS. 1 and 2, glue is applied along the length of respective bottom ledge portions 25 and the bottom surface 36 of single clapboard 13 is passed thereonto so that the vertical rear surface 34 is in abutting engagement with vertical section 24. The other exterior wall sections are joined to support elements 10 in a similar fashion. It can be seen that bottom ledge portion 25 should be of sufficient width to receive the bottom surface 36.

The ground flooring 19 is cut to the desired dimensions and is joined to the support element 10 by applying glue to the top ledge portion 20 and pressing bottom surface 41 adjacent edges 42 thereonto. The edges 42 should be flush with front edges 23. The top ledge portion 20 need only be wide enough to support the ground flooring 19 sufficiently. The height of the ground flooring 19 is such that, when the flooring 19 is in place on support element 10, the top surface 40 is level with the top surface 35 of single clapboard member 13; the tongue 37 will extend above top surface 40.

Figure 3:
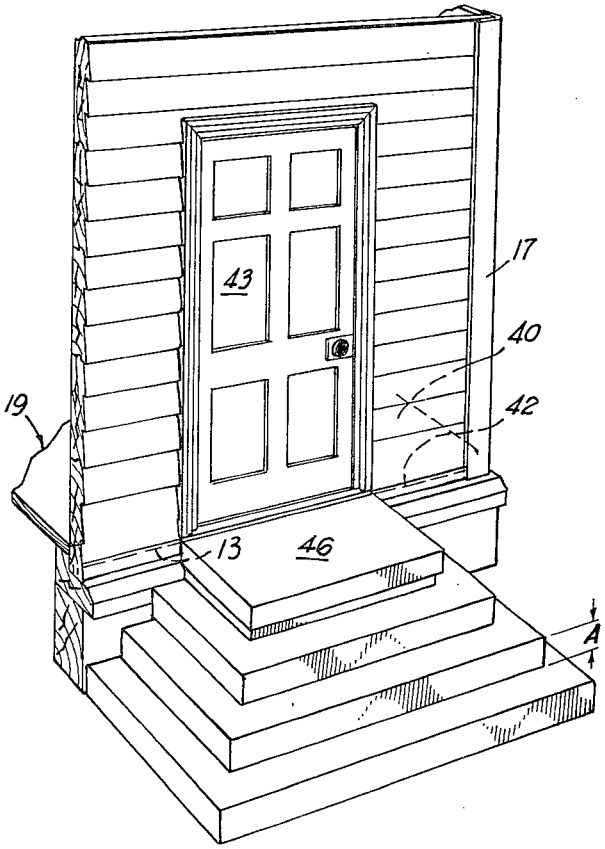
FIG. 3 is a partial perspective of the front of a miniature house constructed with the present invention.

Referring to FIG. 3, the top surface 40 is flush with the bottom of door 43. The distance between the underside 28 to the top ledge portion 20 is equivalent to the distance A between steps 45 forming the outside steps leading up to the door 43. Therefore, the top 46 of the last step is flush with the top surface 40 of the ground flooring 19.

B. Second Embodiment

Figure 4:
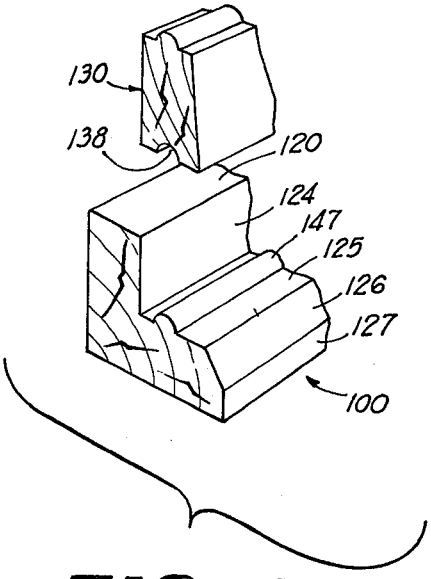
FIG. 4 is a detailed, exploded, partial perspective view of the second embodiment of the present invention.

As shown in FIG. 4, the second embodiment of the present invention is referred to by numeral 100 and is similar to support element 10 in having a top ledge portion 120, vertical depending section 124, bottom ledge portion 125, sloping portion 126 and depending section 127. To aid in positioning the single clapboard member 130 on bottom ledge portion 125, a longitudinally extending tongue 147 protrudes upwardly from bottom ledge portion 125 for mating engagement with groove 138 on single clapboard member 130. The tongue 147 can also be used to engage the groove on the underside of a triple clapboard unit. The construction of a house using support member 100 is identical to the construction of house 11 described above.

C. Third Embodiment

Figure 5:
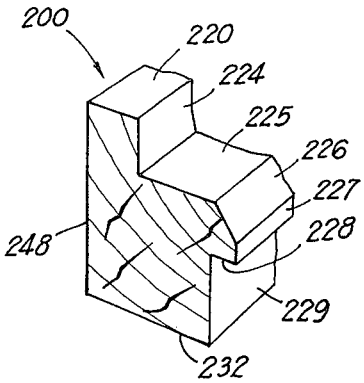
FIG. 5 is a partial perspective view of the third embodiment of the present invention wherein the support member is integrally formed with the foundation piece.

FIG. 5 shows the third embodiment of the present invention, support element 200 which combines as an integral unit the foundation piece 12 and the support element 10 of the first embodiment. The support element 200 includes a top shelf portion 220, vertical depending section 224, bottom portion 225, sloping portion 226 and depending section 227 which terminates in ledge portion 228. The rear of ledge portion 228 terminates in front wall surface 229. The underside 232 is flat and the rear wall 248 of the support element 200 is planar.

The support element 200 is utilized in the same manner as was the combination of the foundation piece 12 and the support element 10, in that the bottom of an exterior wall section would be joined to bottom ledge portion 225 and the underside of the ground flooring would be joined to the top ledge portion 220.

D. Fourth Embodiment

Figure 6:
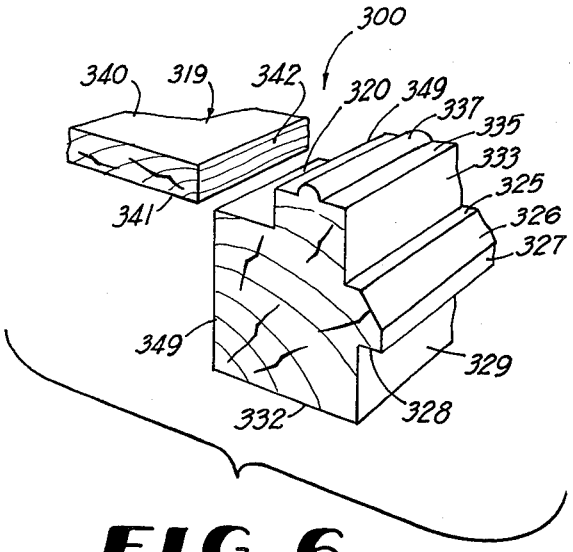
FIG. 6 is an exploded, partial perspective view of the fourth embodiment of the present invention wherein the single clapboard, support member and the foundation piece are integrally formed.

The fourth embodiment of the support element is referred to generally by the numeral 300 in FIG. 6 and is a combination of the foundation piece 12, the support element 10 and the single clapboard member 13 of the first embodiment. The support element 300 includes a top ledge portion 320, upwardly projecting wall 349 which terminates in top surface 335 having tongue 337 longitudinally extending therefrom. Top surface 335 terminates in depending vertical front surface 333 which, in turn, terminates in laterally projecting bottom ledge portion 325 that ends in downwardly sloping section 326 which terminates in depending section 327. The ledge portion 328 extends to the depending front wall surface 329. The bottom 332 of the support element 300 is flat. The rear face 349 is parallel to surfaces 333 and 329.

The ground flooring 319 has bottom 341 and edge 342 which abuts the wall 349 when the bottom 341 is joined with glue to top ledge portion 320. So connected, the surface 340 is coplanar with top surface 335. The support element 300 eliminates the need to size, cut and glue together separate foundation pieces, support elements and single clapboard members.

The above described embodiments have been shown and described relative to the exterior wall sections being of clapboard design. It is understood, of course, that the house 11 can be constructed of any suitable design without affecting the design or function of the support element.

What is claimed is:

1. An improvement in the construction of a miniature home comprising ground flooring having a top surface, an underside and outer edges and an exterior side wall section having front, back and bottom surfaces, the improvement comprising:

means for simultaneously supporting said flooring and said exterior side wall section in perpendicular relationship to each other, said supporting means comprising an L-shaped member having a top ledge portion, a bottom ledge portion and a vertical section interconnecting said top and bottom ledge portions with said top ledge portion terminating in said vertical section and said bottom ledge portion laterally extending from the bottom of said vertical section for a distance at least equal to the width of said exterior wall section, whereby said flooring is supported on said underside adjacent said outer edges on said top ledge portion and said exterior wall section is supported along said bottom surface on said bottom ledge portion, the bottommost member of said exterior wall section being a single unit and the remaining portion of said exterior wall section being formed of multiple units of said single unit and wherein said ground flooring is supported on said top ledge portion so that said top surface of said ground flooring is so-planar with the upper surface of said single unit when said exterior wall section is supported on said bottom ledge portion.

* * * * *